US010101134B2

(12) United States Patent
Chavez

(10) Patent No.: US 10,101,134 B2
(45) Date of Patent: Oct. 16, 2018

(54) COMBAT SPORT ROBOT

(71) Applicant: Felipe De Jesus Chavez, Kingman, AZ (US)

(72) Inventor: Felipe De Jesus Chavez, Kingman, AZ (US)

( * ) Notice: Subject to any disclaimer, the term of this patent is extended or adjusted under 35 U.S.C. 154(b) by 0 days.

(21) Appl. No.: 15/406,604

(22) Filed: Jan. 13, 2017

(65) Prior Publication Data

US 2017/0205208 A1 Jul. 20, 2017

Related U.S. Application Data

(60) Provisional application No. 62/278,892, filed on Jan. 14, 2016.

(51) Int. Cl.

| | |
|---|---|
| ***F41J 9/02*** | (2006.01) |
| ***F41J 5/04*** | (2006.01) |
| ***F41J 5/14*** | (2006.01) |
| ***F41H 7/00*** | (2006.01) |

(52) U.S. Cl.

CPC ..... *F41J 9/02* (2013.01); *F41H 7/005* (2013.01); *F41J 5/04* (2013.01); *F41J 5/14* (2013.01)

(58) Field of Classification Search

CPC ..... F41J 5/04; F41J 5/14; F41J 9/02

USPC ..... 273/359, 371, 375, 406

See application file for complete search history.

(56) References Cited

U.S. PATENT DOCUMENTS

| | | | | |
|---|---|---|---|---|
| 3,578,327 | A * | 5/1971 | Pickell | F41J 5/052 273/375 |
| 4,437,671 | A * | 3/1984 | Busch | F41J 5/04 273/372 |
| 5,613,913 | A * | 3/1997 | Ikematsu | A63F 9/0291 463/52 |
| 7,900,927 | B1 * | 3/2011 | Bliehall | F41J 9/02 273/359 |
| 8,205,888 | B2 * | 6/2012 | Deatherage, Jr. | F41J 5/24 273/384 |
| 8,632,376 | B2 * | 1/2014 | Dooley | A63F 9/143 273/246 |
| 8,712,602 | B1 * | 4/2014 | Oliver | F41H 7/005 701/1 |
| 9,726,463 | B2 * | 8/2017 | Pettey | F41J 9/02 |
| 9,797,694 | B1 * | 10/2017 | Cummins | F41J 1/10 |
| 2004/0248633 | A1 * | 12/2004 | Trawick | A63B 69/34 463/8 |
| 2005/0017456 | A1 * | 1/2005 | Shechter | F41J 5/056 273/371 |
| 2007/0105070 | A1 * | 5/2007 | Trawick | F41A 23/10 434/11 |
| 2010/0038854 | A1 * | 2/2010 | Mraz | F41J 5/041 273/371 |
| 2012/0208150 | A1 * | 8/2012 | Spychaiski | F41H 7/005 434/20 |
| 2015/0123346 | A1 * | 5/2015 | Mason | F41J 1/10 273/371 |

(Continued)

*Primary Examiner* — Mark Graham

(57) ABSTRACT

The NON-LETHAL Combat Sport Robot is a tactical tool for people in the combat sports world. The robot can move through terrain and has a movable upper head piece to aim non-lethal guns and a camera to defeat opponents. It is equipped to be able to play within the rules and confines of the Combat sports. It achieves this by introducing a suite of devices including non lethal guns, mercy shot light, death flag and hit switches to comply with traditional combat sport rules.

1 Claim, 7 Drawing Sheets

(56) References Cited

U.S. PATENT DOCUMENTS

| | | | | |
|---|---|---|---|---|
| 2016/0008695 | A1* | 1/2016 | Aman | A63B 71/0669<br>348/157 |
| 2016/0033240 | A1* | 2/2016 | Graham | F41J 7/04<br>273/371 |
| 2016/0091285 | A1* | 3/2016 | Mason | F41J 5/04<br>273/372 |

* cited by examiner

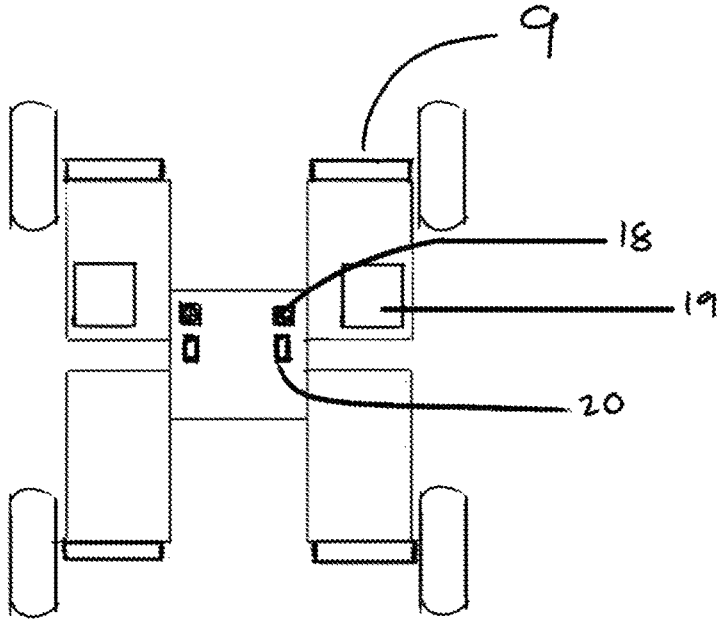
FIG. 3
FIG. 3B
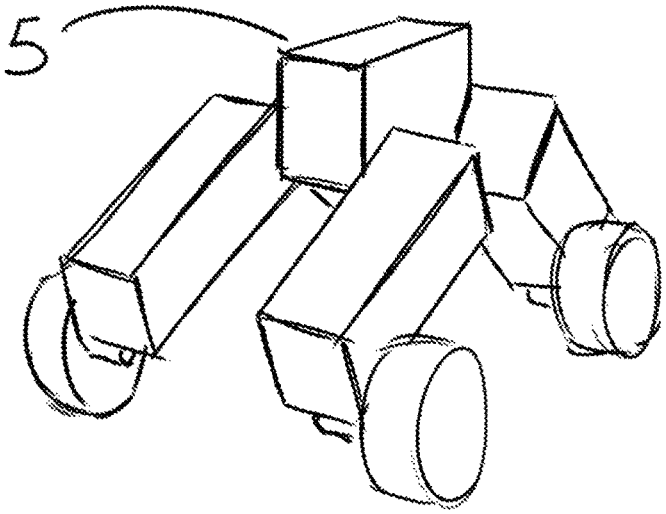

COMBAT SPORT ROBOT

REFERENCES

U.S. Patent Documents
U.S. Pat. No. 9,028,312
U.S. Pat. No. 9,435,617
U.S. Pat. No. 8,712,602 B1
Foreign Patent Documents
Great Britain patent number PCT/GB2015/051076
China patent number PCT/CN2014/076832

Statement to federally sponsored research or development (not applicable)

The names of the parties to a joint research agreement if the claimed invention was made as a result of activities within the scope of a joint agreement (not applicable)

Reference to a sequence listing, a table or computer program listing appendix submitted on a compact disc and incorporation by reference of the material on the compact disc. The total number of compact disc including duplicates and files on each compact disc shall be specified. (not applicable)

Statement regarding prior disclosures by the inventor or joint inventor(not applicable)

BACKGROUND OF THE INVENTION

The combat sport is a game of strategy and technology. In prior art robot devices are described and engineered with a concentration in real world combat scenarios. Some related matter involved training devices to train law enforcement. For example in one invention (U.S. Pat. No. 9,052,165) consists of real combat ready designs to deflect bullets and achieve stealth. In one particular invention (U.S. Pat. No. 8,655,257) a robot shaped like a human is used for training people in firefight engagement, however the tall humanoid design makes it impractical in terrain situations due to toppling over risk. U.S. Pat. No. 8,655,257 ignores a gun configuration with wide spread projectile fire. The low chassis design in U.S. Pat. No. 8,655,257 also would make it problematic in handling over terrain and the gun configuration a hassle to achieve accuracy.

There are robots that use similar mechanics to achieve movement and shooting. Some of these inventions handle dangerous or hazardous environments too dangerous for people. This invention differs from other similar inventions in many ways. This particular invention is more for sport related tactical advantage and entertainment and not in any way for real combat use.

In general the prior art ignores tailoring a comprehensive practical platform to play within combat sport rules and parameters. The prior art mentioned is in the real combat and training niche with different approaches to functionality.

BRIEF SUMMARY OF INVENTION

This invention is a small sized robot used to aid in espionage, assault and augmentation of tactical advantage in combat sports. It is sized and shaped in an appropriate manner to move through environments. The four leg suspended chassis reduces contact points with debris for better terrain movement. Its advantages include the comprehensive suite of devices optimized for combat sport competition. The hit switch system lets the operator know that the robot is being hit. When all switches have been hit, the operator flips a switch on the transmitter that raises a death flag on the robot to show other players the robot has been disqualified.

The mercy shot light is triggered by the operator to show opponent he/she is defeated at a less than ideal distance. The mercy shot light's main purpose is to disqualify opponents without shooting at close range for the reason that it is painful.

The wide spread projectile trajectory grouping achieved by two non-lethal guns paired one on each side of the robot's upper head piece increase the probability of hitting the opponent. The limited range of the horizontal rotational axis forces the robot to keep visual to the front area to force confrontation in front of the robot, where all the valid hit switches are located. This reduces the chances of operator being overwhelmed or fall in ruse with confusion by opponent. The robot is advantageous in its structure for simple maintenance. It is lightweight and can be reconfigured and upgraded with extra parts to augment performance. Everything in this robotic platform brings a comprehensive setup for implementing a robot into an combat sport game with its rules. The described robot is a tactical augmentation to a combat sport player's game.

BRIEF DESCRIPTION OF DRAWINGS

FIG. 3 is the view of the suspended lower chassis, motors for terrain motion and electronics.

FIG. 3B is a perspective view of the suspended lower chassis with empty clearing below

DETAILED DESCRIPTION OF THE INVENTION

Figure 1:
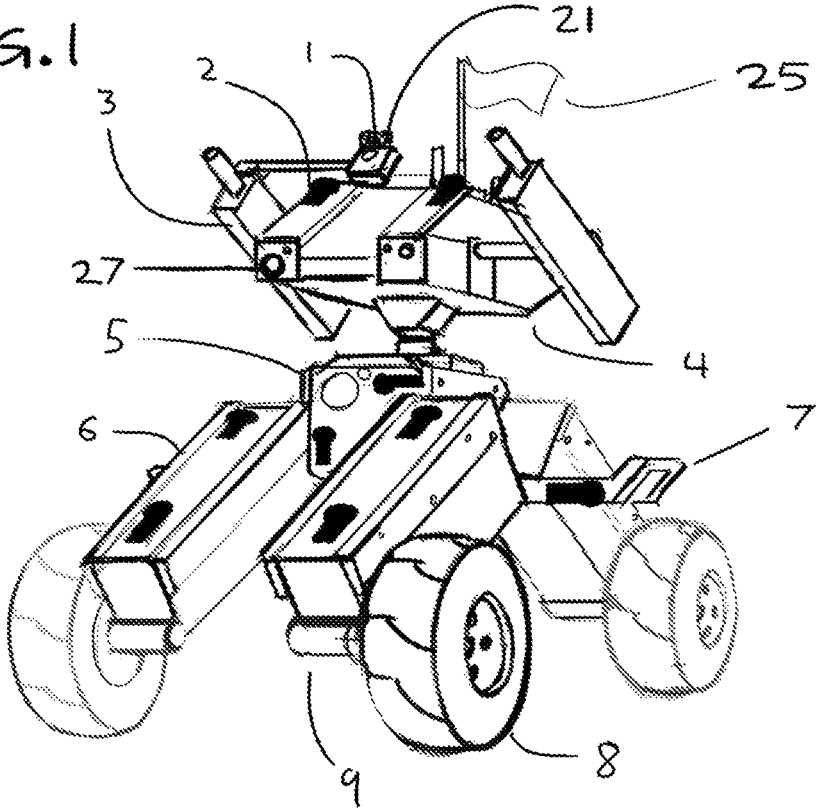
FIG. 1 is a view of the entire robot platform.

FIG. 1 Shows the robot. It features a camera 1 connected to the right non-lethal gun 3 and centered at the front in between both non lethal-guns 3 by arm extension for better projectile spread trajectory and hit probability to eliminate opponent. The hit switches 2 are scattered throughout the robot and are individually directly connected to a LED light on the LED light panel 21 that the camera 1 and operator can see. The upper head piece 4 has electrical components. The suspended lower chassis 5 is part of a four leg piece 6 suspended design to minimize contact with obstructions. The leg pieces 6 extend down diagonally to connect with their corresponding motor 9. The motors 9 turn their respective wheels 8 to achieve movement. The carry handles 7 on each side are meant for safe way of carrying the robot by hand without damaging the robot. The mercy shot light 27 disqualifies opponents at close range without shooting them.

Figure 1B:
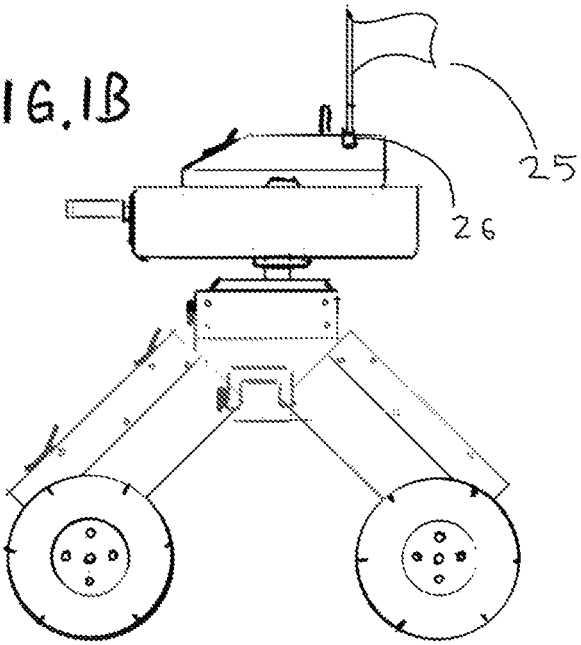
FIG. 1B is the side view of the robot

FIG. 1B The image is a side view of the robot, it includes the death flag 25 actuated by servo 26

Figure 2:
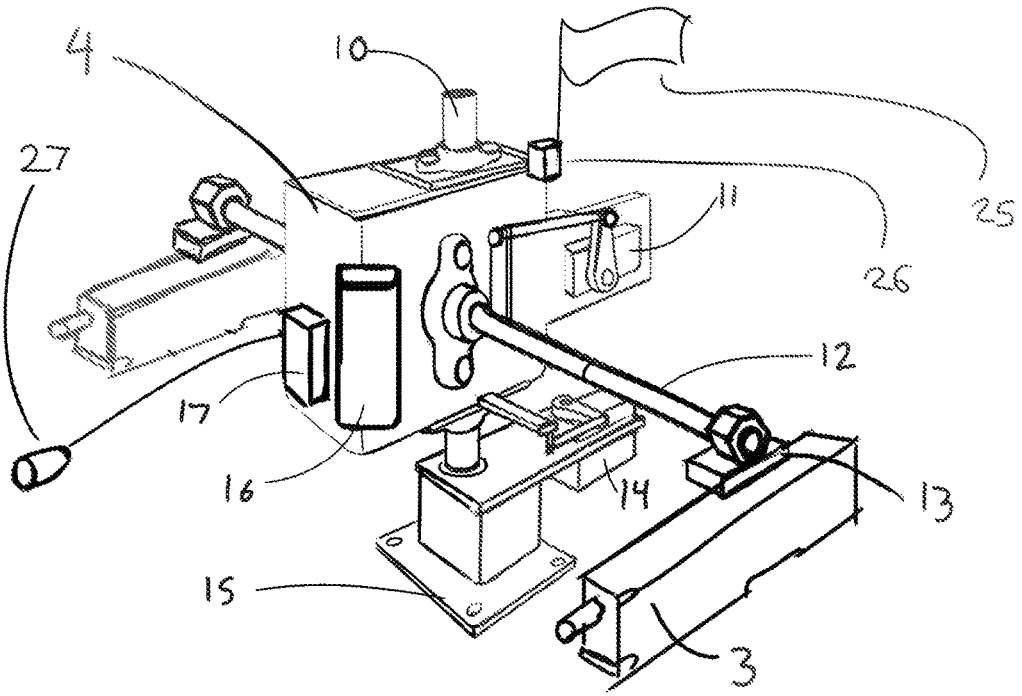
FIG. 2 is a view of the upper head piece with servos, mechanics for aiming, shooting the non-lethal guns, the mercy shot light and death flag are also on this picture.

FIG. 2 shows the internal components of the head piece 4 shown in FIG. 1. These are all of the mechanics necessary to rotate horizontally and vertically pivot the non-lethal guns 3 shown in FIG. 1. The vertical shaft 10 is for horizontal rotational left/right movement in correspondence with the servo 14. The horizontal shaft 12 is a rotational axis for pivoting the non-lethal guns 3 vertically up and down. The horizontal shaft 12 achieves its task by being actuated by servo 11. The non-lethal guns 3 are clamped by the gun grips 13 at each end of the horizontal shaft 12. The death flag 25 acts as a visual indicator to opponents that the robot is disqualified and is actuated by servo 26 by operator. The mercy shot light 27 is activated by operator input through control unit 23 to signal opponent that he/she is disqualified without firing at opponent at close range. The servos 11,14 and 26 are connected and controlled by a receiver 17. Both non-lethal guns 3 are fired through receiver 17. The receiver 17 is powered by a battery 16. The lower plate 15 connects to the suspended lower chassis 5 in FIG. 3.

FIG. 3 This picture is the suspended lower chassis 5 that achieves the robot's movement. The motors 9 are connected to electric speed controls 18. The electric speed controls 18 are controlled by a receiver 20 separate from other receiver 17 on FIG. 2. The receiver 20 is powered by battery 19 separate from battery 16 on FIG. 2. Receiver 20 receives input through control unit 23 on FIG. 4.

FIG. 3B is a perspective drawing of suspended lower chassis 5 with clearing below for reducing contact points with debris and better terrain handling.

Figure 4:
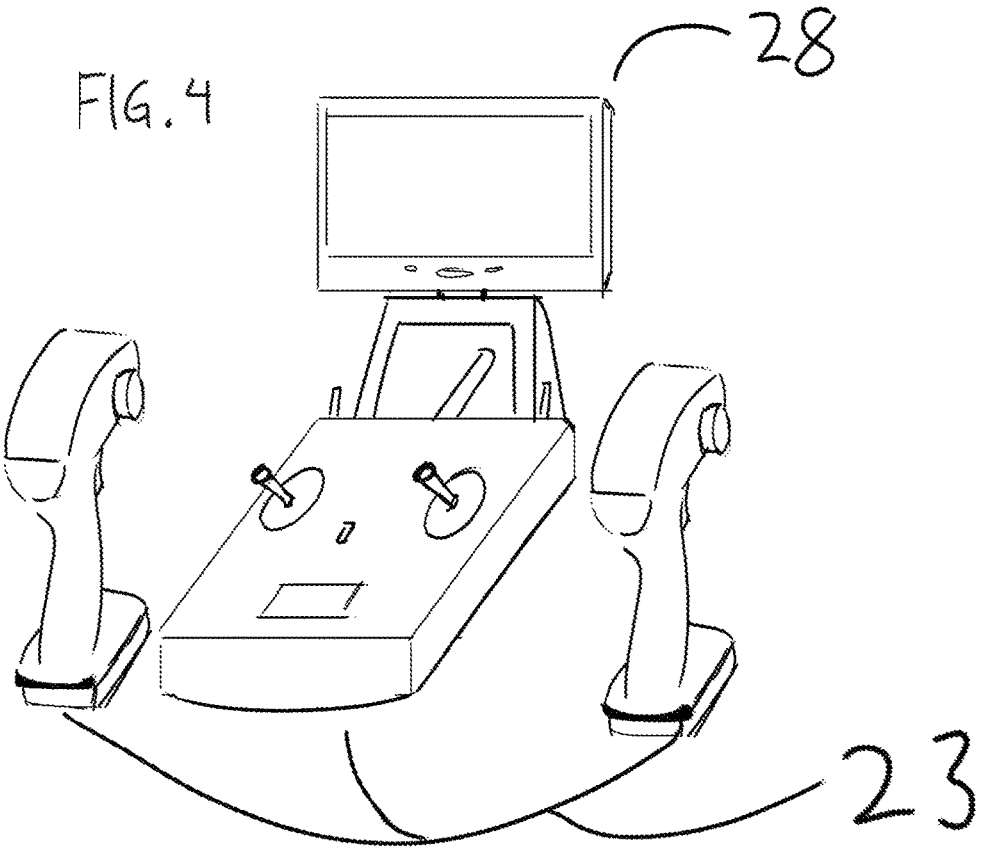
FIG. 4 is the control unit for controlling the robot's movement including terrain mobility, upper head piece, gun firing, mercy shot light and death flag. It also receives video input from the robot to the screen.

FIG. 4 In the control unit 23 in which the robot receives input and gives output to receiver 20 and receiver 17. The control unit 23 also receives video picture from camera 1 and hit input from LED light panel 21 though LCD monitor 28.

Figure 5:
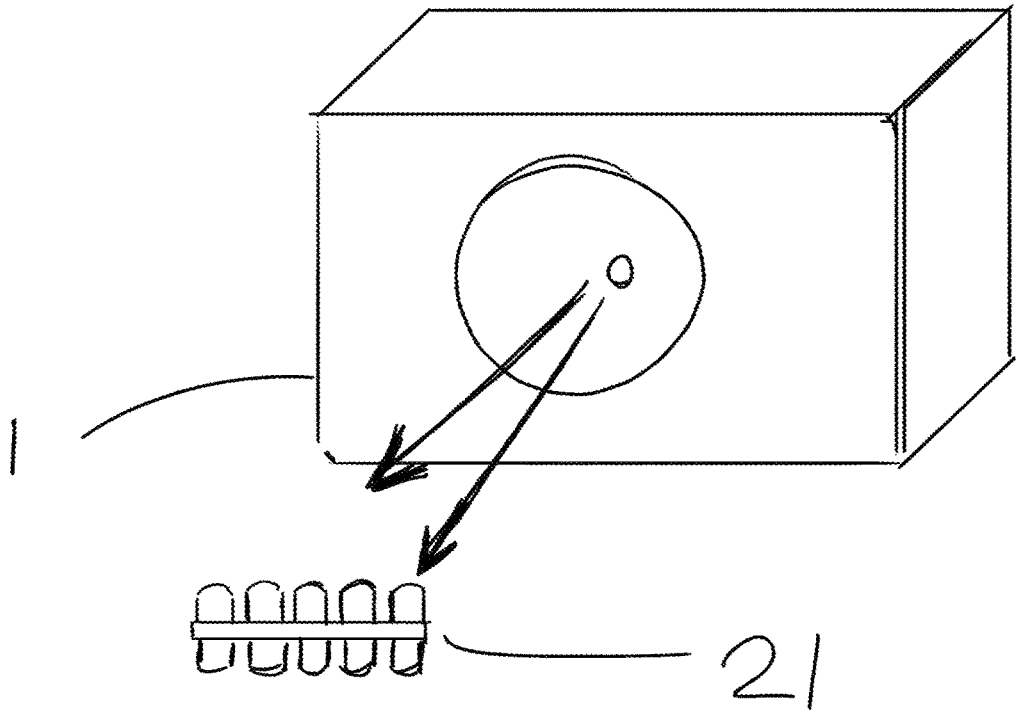
FIG. 5 is a picture of LED light panel in front of the camera used to count the projectile hits on the robot.

FIG. 5 This is the camera 1. It is used to view and aim at opponents by operator control input. The LED light panel 21 for indicating hits to operator are in front of and visible to the camera 1. One LED light on LED light panel 21 is activated whenever a corresponding hit switch 2 is hit to keep track of shots until robot is disqualified.

Figure 6:
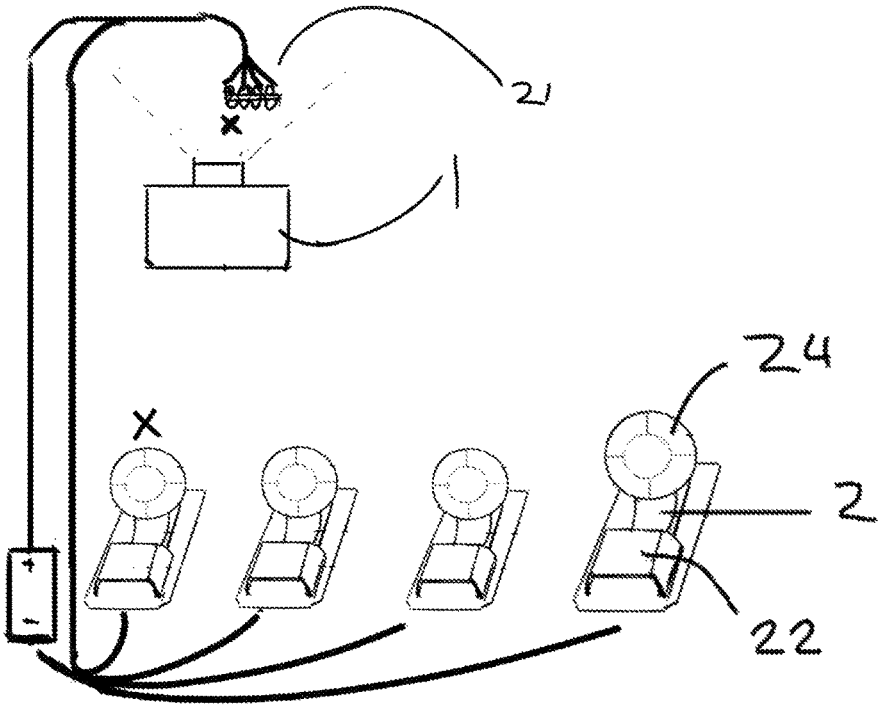
FIG. 6 is a diagram of a hit switch being the completing circuit for LED light panel for showing hits to operator.

FIG. 6 is a diagram of a hit switch 2 set up to activate LED lights on LED light panel 21 to indicate a registered hit to operator through camera 1 when hit switch 2 is hit by a projectile.

Figure 7:
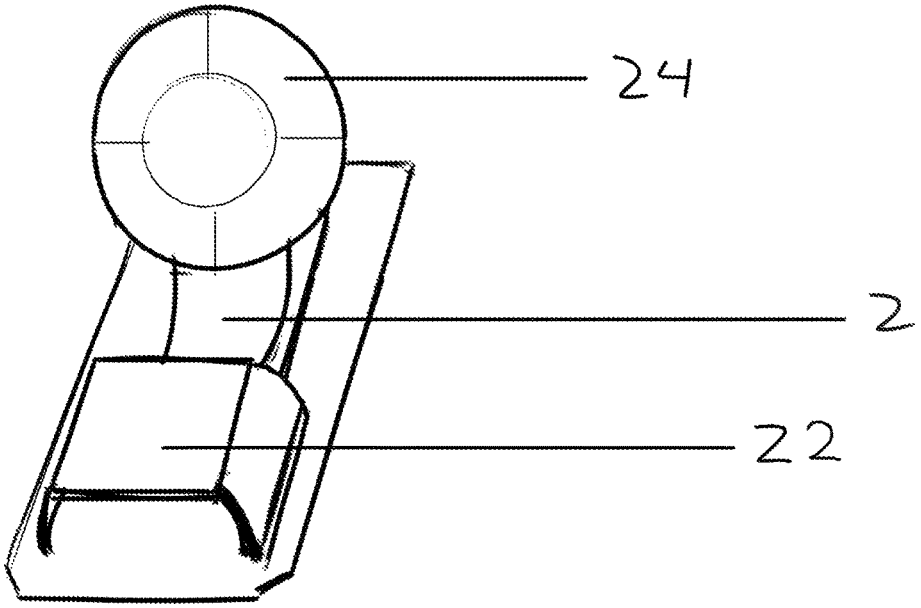
FIG. 7 is a picture of the hit switch for registering shots from projectiles.

FIG. 7 This an image of the rocker type switch that is used to register hits by a projectile. The hit switch 2 has a target plate 24 to allow projectiles to activate the switch more easily. The anti hit guard 22 is placed over the other half of the hit switch 2 to prevent random projectiles from hitting the hit switch 2 and undoing the registered hit.

The invention claimed is:

1. A radio controlled combat robot comprising;

an array of hit switches that detect an impact from a projectile;

the switches being individually connected to a corresponding LED light on an LED light panel to keep track of switches that have been hit, a camera is installed to allow an operator to see the LED light panel, the LED lights are visible through the camera and visible to the operator;

the hit switches being rocker type switches that have a target plate attached to one half of the rocker switch surface to allow the hit switch to be hit easily and activated when hit by projectiles;

the rocker switches having an anti hit guard over the other half of the switch surface to prevent registered shots from bering deactivated, a target plate allowing the switches to be reset as needed by the operator;

the robot having a four leg suspended chassis with a motor connected at the end of each leg for mobility, each motor coupled to a corresponding wheel, the legs having batteries stored inside, the chassis having two carry handles;

the robot having a set of gun grip clamps that are connected to a horizontal shaft wherein various non-lethal weapon platforms can be connected to the gun grip clamps, the camera being located in between non-lethal guns at a center front position of an upper head piece and attached to a right non-lethal gun, the non-lethal guns being placed one on each side of the upper head piece, the non-lethal guns pivotal up and down and rotatable left and right with the upper head piece;

the robot equipped with a mercy shot light that disqualifies and defeats opponents at close quarter range where close quarter engagements would be too painful or against the rules, the mercy shot light capable of be activated at the operator's discretion, the robot having a death flag that signifies that the robot is disqualified, the death flag actuated by a servo.

* * * * *